US007559622B2

(12) United States Patent
Tanaka

(10) Patent No.: US 7,559,622 B2
(45) Date of Patent: Jul. 14, 2009

(54) TEST OPERATION FOR INKJET PRINTER AND MULTIFUNCTIONAL MACHINE

(75) Inventor: Masanori Tanaka, Kanagawa (JP)

(73) Assignee: Ricoh Company, Ltd, Tokyo (JP)

( * ) Notice: Subject to any disclaimer, the term of this patent is extended or adjusted under 35 U.S.C. 154(b) by 247 days.

(21) Appl. No.: 11/374,035

(22) Filed: Mar. 14, 2006

(65) Prior Publication Data

US 2006/0209116 A1 Sep. 21, 2006

(30) Foreign Application Priority Data

Mar. 15, 2005 (JP) ..... 2005-073933

(51) Int. Cl.
*B41J 2/165* (2006.01)

(52) U.S. Cl. ..... 347/23; 347/19

(58) Field of Classification Search ..... 347/23
See application file for complete search history.

(56) References Cited

U.S. PATENT DOCUMENTS 4,914,455 A * 4/1990 Hayes ..... 347/131
6,109,724 A * 8/2000 Takahashi et al. ..... 347/23
6,488,353 B1 * 12/2002 Itoyama et al. ..... 347/19
6,565,185 B1 * 5/2003 Endo ..... 347/23

FOREIGN PATENT DOCUMENTS

| | | |
|---|---|---|
| JP | 07-076093 | 3/1995 |
| JP | 07-150068 | 6/1995 |
| JP | 08-244244 | 9/1996 |
| JP | 09-057966 | 3/1997 |
| JP | 11-348313 | 12/1999 |
| JP | 2000-028820 | 1/2000 |
| JP | 2000-094701 | 4/2000 |
| JP | 2000-141864 | 5/2000 |
| JP | 2002-003758 | 1/2002 |
| JP | 2002-187293 | 7/2002 |
| JP | 2002-240265 | 8/2002 |
| JP | 2003-145783 | 5/2003 |
| JP | 2003-251829 | 9/2003 |
| JP | 2003-300313 | 10/2003 |

* cited by examiner

*Primary Examiner*—Matthew Luu
*Assistant Examiner*—Brian J Goldberg
(74) *Attorney, Agent, or Firm*—Harness, Dickey & Pierce, P.L.C.

(57) ABSTRACT

An inkjet printer including a plurality of inkjet heads for recording a one or more colors on a document, a determining part for determining whether a first test-jetting operation is required to be executed by one of the plural inkjet heads designated to record a predetermined color on the document, and a recording control part for instructing the designated inkjet head to execute the first test-jetting operation prior to recording the predetermined color when the determining part determines that the first test-jetting operation is required to be executed by the designated inkjet head.

2 Claims, 7 Drawing Sheets

TEST OPERATION FOR INKJET PRINTER AND MULTIFUNCTIONAL MACHINE

BACKGROUND OF THE INVENTION

1. Field of the Invention

The present invention relates to an inkjet printer having multiple recording heads corresponding to multiple colors, and more particularly to a full color inkjet printer. The inkjet printer is, however, not limited to the full color inkjet printer and may also be used as a copying machine, a facsimile machine, and a multifunctional machine.

2. Description of the Related Art

In recent years and continuing, high quality (color photo quality) printing using an inkjet recording method is drawing attention. Meanwhile, there is also a high demand for high speed black and white printing (monochrome printing) such as printing business documents. Although the inkjet printing is mainly performed for black and white printing, color printing is also sometimes desired. In the inkjet printing, the nozzle parts for jetting ink of respective colors (e.g. yellow Y, magenta M, cyan C, and black K/Bk) may be clogged with the ink due to a dry atmosphere or long term use. Therefore, a cleaning operation is performed so that ink can be properly jet from the nozzles.

One of the tasks in inkjet printing is to prevent the nozzle from clogging. As for solutions for preventing such nozzle clogging, there is, for example, modification of ink (for example, Japanese Laid-Open Patent Application Nos. 2000-028820, 2002-003758), modification of nozzle structure (Japanese Laid-Open Patent Application No. 7-150068, 2003-145783), and modification of recording method (Japanese Laid-Open Patent Application Nos. 9-057966, 11-348313). Meanwhile, there is also a problem in that a test-jetting operation performed for cleaning the nozzle requires a considerable amount of time. In other words, a printing process cannot be performed during the test-jetting operation (cleaning operation). Japanese Laid-Open Patent Application No. 2003-251829 discloses a method of shortening the step of test-jetting with the heads of each color. Japanese Laid-Open Patent Application No. 2000-94701 discloses a method of reducing the number of times for performing test-jetting in relation with the amount of use of the heads of each color.

SUMMARY OF THE INVENTION

It is a general object of the present invention to provide an inkjet printer and a multifunctional machine that substantially obviates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by an inkjet printer and a multifunctional machine particularly pointed out in the specification in such full, clear, concise, and exact terms as to enable a person having ordinary skill in the art to practice the invention.

To achieve these and other advantages and in accordance with the purpose of the invention, as embodied and broadly described herein, the present invention provides an inkjet printer including: a plurality of inkjet heads for recording a one or more colors on a document; a determining part for determining whether a first test-jetting operation is required to be executed by one of the plural inkjet heads designated to record a predetermined color on the document; and a recording control part for instructing the designated inkjet head to execute the first test-jetting operation prior to recording the predetermined color when the determining part determines that the first test-jetting operation is required to be executed by the designated inkjet head.

In the inkjet printer according to an embodiment of the present invention, when another color is designated to be recorded on the document, the determining part determines whether the first test-jetting operation is required to be executed by an inkjet head corresponding to the other color, wherein the recording control part instructs the inkjet head corresponding to the other color to execute the first test-jetting operation prior to recording the other color when the determining part determines that the first test-jetting operation is required to be executed by the inkjet head corresponding to the other color.

In the inkjet printer according to an embodiment of the present invention, the determining part determines whether the execution of the first test-jetting operation is required during a period of waiting for a command to record a predetermined color on the document, wherein the recording control part instructs the first test-jetting operation to the inkjet head determined to require the execution of the first test-jetting operation.

In the inkjet printer according to an embodiment of the present invention, the determining part determines that the first test-jetting operation is required when a discontinue period of an inkjet operation is equal to or greater than a first predetermined value.

In the inkjet printer according to an embodiment of the present invention, the determining part determines whether a second test-jetting operation is required to be executed by one of the inkjet heads immediately after power is applied to the inkjet printer, wherein the recording control part instructs the second test-jetting operation to the inkjet head determined to require the execution of the second test-jetting operation.

In the inkjet printer according to an embodiment of the present invention, the determining part determines that the second test-jetting operation is required when a discontinue period of an inkjet operation is equal to or greater than a second predetermined value.

In the inkjet printer according to an embodiment of the present invention, the first test-jetting operation for the predetermined color is cancelled when recording of another color is designated during the first test-jetting operation for the predetermined color.

Furthermore, the present invention provides a multifunctional machine including: a document scanner for reading image data from a target document; the inkjet printer according to an embodiment of the present invention; and an image data processing part for converting the image data read by document scanner into another image data applicable for the inkjet printer.

Other objects and further features of the present invention will be apparent from the following detailed description when read in conjunction with the accompanying drawings.

DESCRIPTION OF THE PREFERRED EMBODIMENTS

In the following, embodiments of the present invention are described with reference to the accompanying drawings.

First Embodiment

Figure 1:
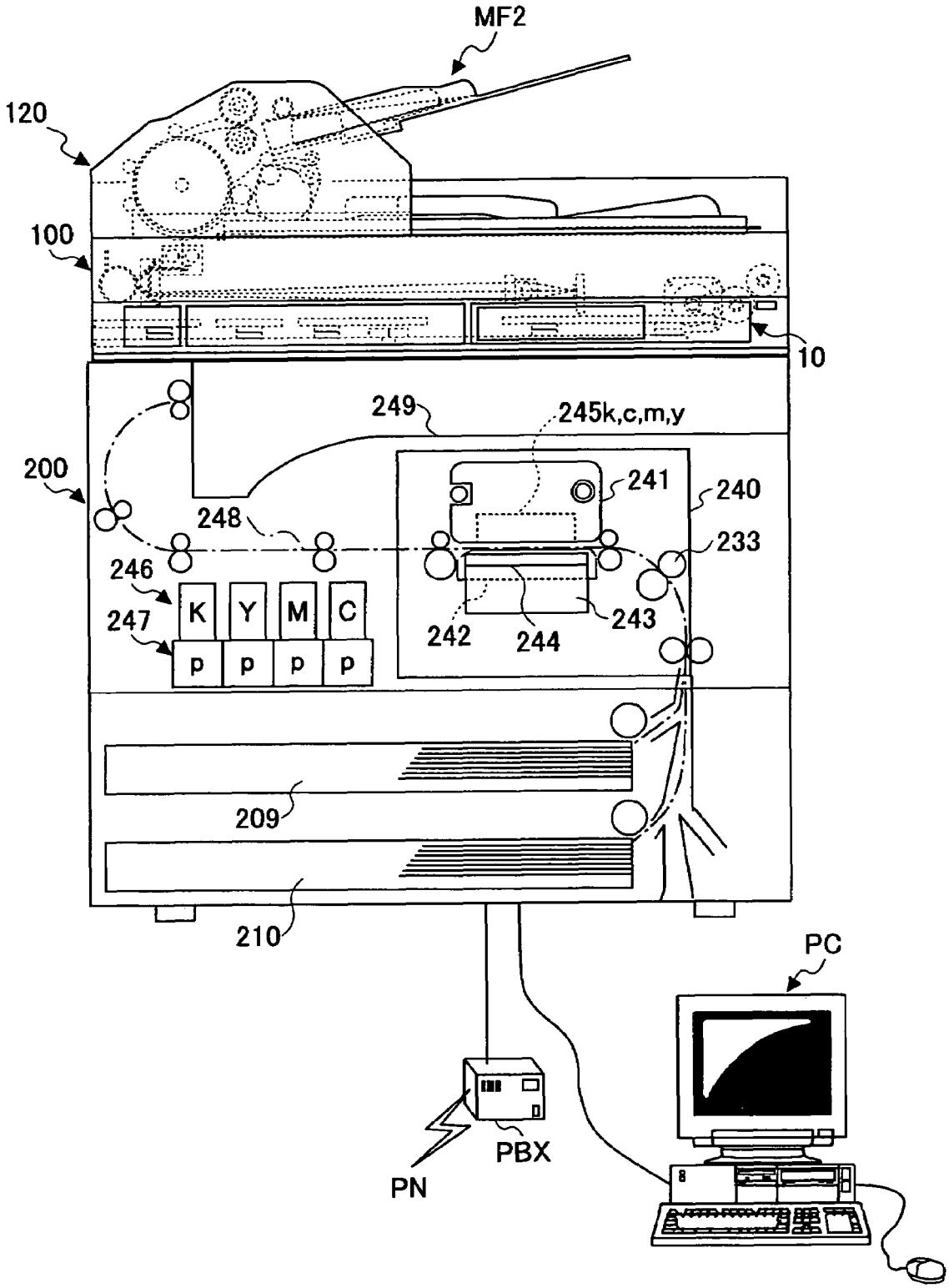
FIG. 1 is a front view showing an exemplary configuration of a multifunctional machine including an inkjet printer according to the first embodiment of the present invention.

FIG. 1 shows an exemplary configuration of a full color digital multifunctional copying machine MF2 according to the first embodiment of the present invention. The full color multifunctional machine MF2 includes units of, for example, an automatic document feeder (ADF) 120, a control board 10, a scanner 100 (in this example, a color scanner), and a printer (in this example, an inkjet color printer) 200. The color scanner 100, provided with the control board 10 and the ADF 120, is separable from the printer 200. The scanner 100 also includes a control board having, for example, a power driver, a sensor input, and a controller. The scanner 100 communicates directly or indirectly with an engine controller (CPU 301 in FIG. 2) so as to control the timing for reading a target image (document image).

A controller board 400 (See FIG. 2), which is connected to an engine 300 including the scanner 100, the printer 200, and an image input/output apparatus 302 (see FIG. 2), is also connected to a LAN (Local Area Network) that is connected to a personal computer (PC). A facsimile control unit (FCU) is connected to a switchboard PBX that is connected to a telephone line PN (facsimile communication line).

In the printer 200, four color inkjet heads 245*k*, 245*c*, 245*m*, and 245*y* are installed in a carriage 241 that moves in a main scanning direction x (direction from the front side to back side of FIG. 1). C, M, Y, K ink recording heads, which have plural ink-jetting nozzles densely provided in a sub-scanning direction y (direction from the left to right of FIG. 1), are aligned in the main scanning direction x. In a single scan of the carriage 241 in the main scanning direction x where ink of respective colors is jet from respective recording heads, a color image is formed having a predetermined width in the sub-scanning direction y. Then, after shifting the target document in the sub-scanning direction for a predetermined width, another single scan is performed in the main scanning direction. By repeating this process, the target document is delivered from a document cassette 209, 210 to a resist roller 233, to thereby perform color printing on the document conveyed along a sheet conveying line 248. After an image is recorded on the document, the document is delivered to a sheet discharge tray 249. Reference numerals 246 indicate respective ink cartridges containing C ink, M ink, Y ink, and K ink. The ink in each ink cartridge is drawn upward from respective pumps 247 for reinforcing its heads.

At an area outside of a document width area, a wiper 242, an inkjet absorbing part 243, and a nozzle cap 244 are arranged in this order. After the printing process, the inkjet head is driven to the position of the nozzle cap 244 to be covered by the nozzle cap 244. In a case where the time elapsed from the previous printing process (copying process) is short, the nozzle cap 244 is removed from the inkjet head and the inkjet head commences printing by moving within the document width area when there is a command requesting for a printing process or a copying process. In a case where the time elapsed from the previous printing process (copying process) is long, the nozzle cap 244 is removed from the inkjet head and the inkjet head performs a test-jetting process at the position of the inkjet absorbing part 243. Then, the end face of the inkjet head is cleaned by the wiper 242. Then, the inkjet head commences printing by moving within the document width area. Accordingly, removal of the clogs of inkjet nozzles, the cleaning of the head, and prevention of the clogging can be achieved.

Figure 2:
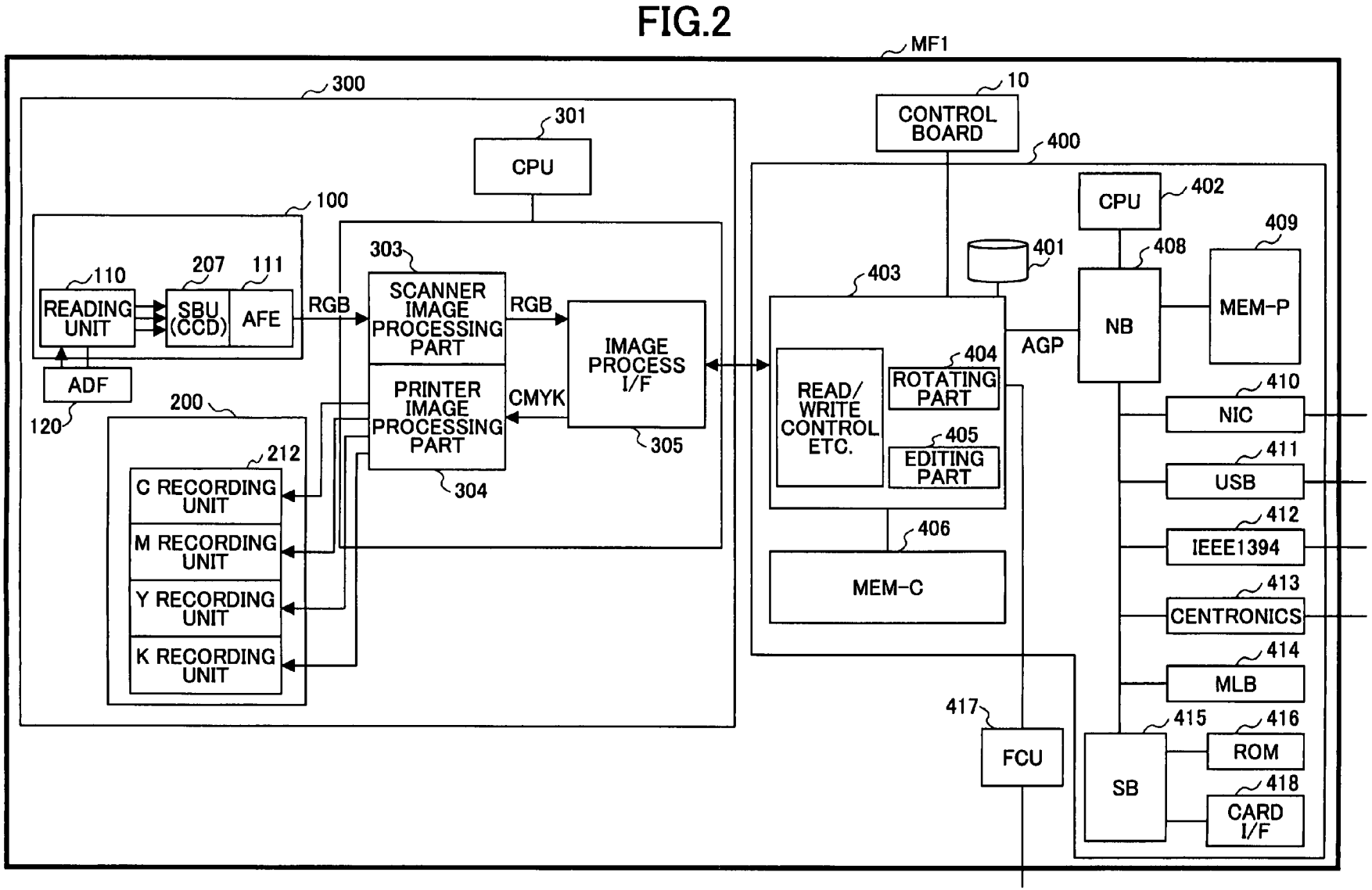
FIG. 2 is a block diagram showing an exemplary configuration of an image processing system in the multifunctional machine including the inkjet printer shown in FIG. 1.

FIG. 2 shows an exemplary configuration of an image processing system included in the multifunctional machine MF2 shown in FIG. 1. The multifunctional machine MF2 includes: for example, an engine 300 for executing an image reading process and a printing process including a color printing process, a controller board 400, and an operation board (control board) 10. The engine 300 includes, for example, a CPU 301 for controlling the image reading process and the printing process, the above-described scanner 100, the above-described printer 200, and the image input/output apparatus 302 including ASIC (Application Specific IC).

The scanner 100 includes a reading unit 110 having a CPU, a ROM, and a RAM. The overall control of the scanner is performed by having the CPU execute the program stored in the ROM by writing in the RAM. The scanner 100 is connected to the CPU 301 via communication lines for performing various processes in accordance with commands and data transmitted from the CPU 301. The CPU inside the reading unit 110 controls the detection and the on/off switching of, for example, a filler sensor (document detection sensor), a base point sensor, a pressure plate, and a cooling fan. In the reading unit 110, a scanner motor driver is activated by a PWM output from its CPU, to thereby generate an excitation pulse sequence and drives a pulse motor for performing a document scanning drive.

The target document (document image) is illuminated by the light from a halogen lamp that is charged by a lamp regulator. The light reflected from the document (i.e. optical signals) is transmitted through plural lenses and mirrors and is received at a CCD 207 (See FIG. 2) including three line sensors for reading R, G, and B components. The CCD 207 transmits image data in analog image signals for respective R, G, and B pixels to a digital process circuit (AFE) 111. The AFE 111 is an image signal processing part for amplifying the signals from the CCD 207, converting the signals into digital signals, and performing shading correction.

The controller board 400 includes, for example, a CPU 402, a image data storage part-(document data storage part) 403, a hard disk apparatus (hereinafter indicated as "HDD") 401, a local memory (MEM-C) 406, a system memory (MEM-P) 409, a north bridge (hereinafter indicated as NB) 408, a south bridge (hereinafter indicated as SB) 415, a NIC (Network Interface Card) 410, a USB device 411, a IEEE 1394 device 412, and a centronics device 413. The operation board 10 is connected to the image data storage part 403 of the controller board 400. A family control unit (FCU) 417 is also connected to the image data storage part 403 via a PCI bus.

The CPU 402 can transmit and/or receive document information with respect to, for example, a personal computer PC in a LAN or the Internet via the NIC 410. The CPU 402 can also communicate with, for example, a personal computer PC, a printer, or a digital computer via the USB 411, the IEEE 1394 device 412, the centronics device 413.

The SB 415, the NIC 410, the USB device 411, the IEEE 1394 device 412, the centronics device 413, and a MLB 414 are connected to the NB 408 via the PCI bus. The MLB 414 is a printed board for connecting to the engine 300 via the PCI bus. The MLB 414 is converts the document data input from and outside device into image data and outputs the converted image data to the engine 300.

In addition to having the image data storage part 403 of the controller board 400 connected to, for example, the local memory 406 and the HDD 401, the image data storage part 403 is connected to the CPU 402 via the NMB 408 of a CPU chip set. The image data storage part 403 and the NB 408 are connected via an AGP (Accelerated Graphics Port).

The CPU 402 performs the overall control of the multifunctional machine MF2. The NB 408 is for connecting the CPU 402, the system memory 409, the SB 415, and the image data storage part 403. The system memory 409 serves as a memory for performing, imaging (drawing) process with the multifunctional machine MF2. The SB 415 is for connecting to the NB 408, the PCI bus, and other peripheral devices. Furthermore, an external ROM 416 and a card I/F (interface) 418 for reading/writing data in a SD memory card (hereinafter referred to as "SD card") are also connected to the SB 415. A card read/write apparatus (card reader) is connected to the card I/F 418 for reading and writing data in the SD card mounted thereto.

The local memory 406 is a memory serving as a copy image buffer and a code buffer. The HDD 401 is for storing, for example, image data, text data, programs, font data, form data, and a LUT (Look Up Table). The operation board 10 is a control panel part for receiving operation input from the user and displaying information to the user.

FIG. 2 shows the flow of image data exchanged among the scanner 100, the printer 200, and the image input/output process apparatus 302. The input/output image processing apparatus 302 includes a scanner image processing part 303 for performing image processing (including, for example, γ correction, MTF correction) on the RGB image data that is read out by scanning the target document with the scanner 100. Furthermore, the input/output image processing apparatus 302 includes a printer image processing part 304 for converting RGB image data into C, M, Y, K recording data (printing data) in accordance with the C, M, Y, K printing characteristics of the printer 200. Furthermore, the input/output image processing part 304 includes an image process I/F (Interface circuit) 305 for outputting the read out RGB data to the image data storage part 403 and providing RGB image data obtained from the image data storage part 403 to the printer image processing part 304.

In a case of a black and white copying operation, G (green) image data is output from the scanner image processing part 303 to the printer image processing part 304 via the image process I/F 305. The printer image processing part 304 converts the G image data to k recording data and if necessary performs additional image processes (e.g. scale change) on the converted data. Then, the printer image processing part 304 performs γ conversion and a gradation process on the converted k recording data and outputs the resultant processed data to a C recording unit in the printer 200. The recording unit 212 drives the inkjet head corresponding to k recording color in accordance with the k recording data output from the printer image processing part 304.

In a case of a color copying operation, RGB image data, which is output from the scanner image processing part 303, is stored (or temporarily stored) in the local memory 406 or the HDD 401 via the image process I/F 305 and the image data storage part 403. The stored image data is read out to be used for a copying process or a printing process or to be sent to an outside apparatus.

In a case of a printing stored image data or image data obtained from an outside apparatus by using the printer 200, the image data is sent to the printer image processing part 304 via the image data storage part 403 and the image process I/F 305. The printer image processing part 304 converts the image data to cmyk recording data and if necessary performs additional image processes (e.g. scale change) on the converted data. Then, the printer image processing part 304 performs γ conversion and a gradation process on the converted data and outputs the resultant processed data to the recording unit 212.

Figure 3:
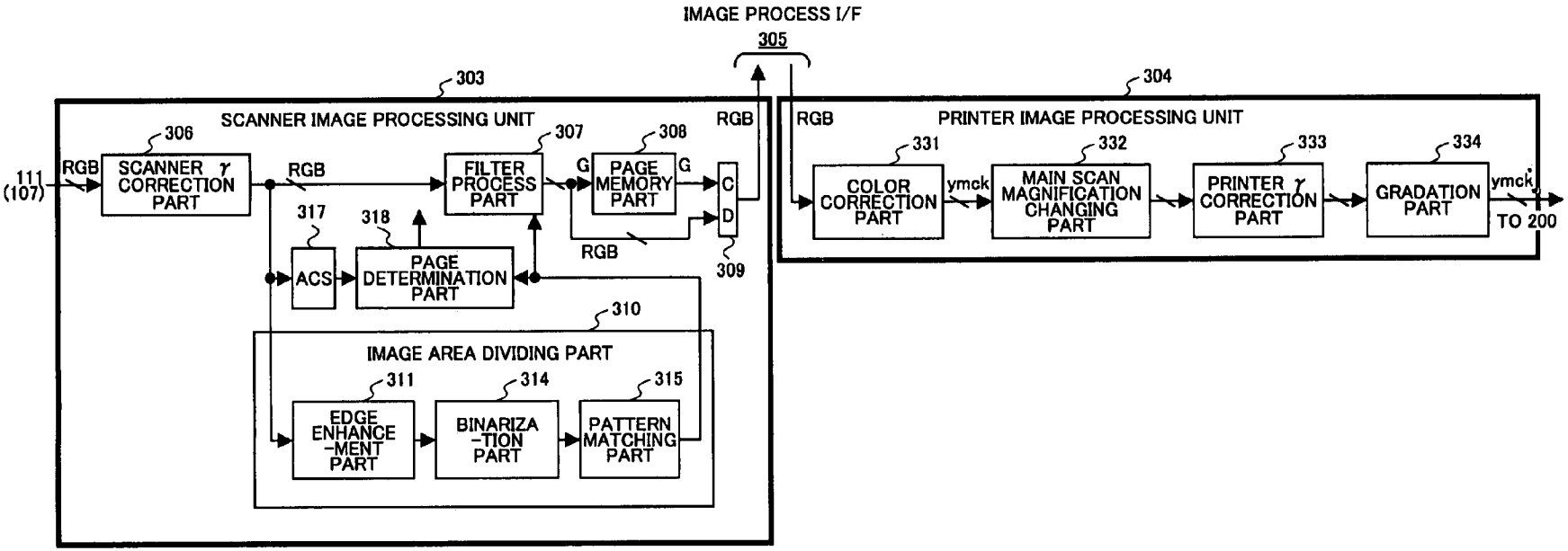
FIG. 3 is a block diagram for describing the functions of a scanner image processing part and a printer image processing part according to an embodiment of the present invention.
Figure 4:
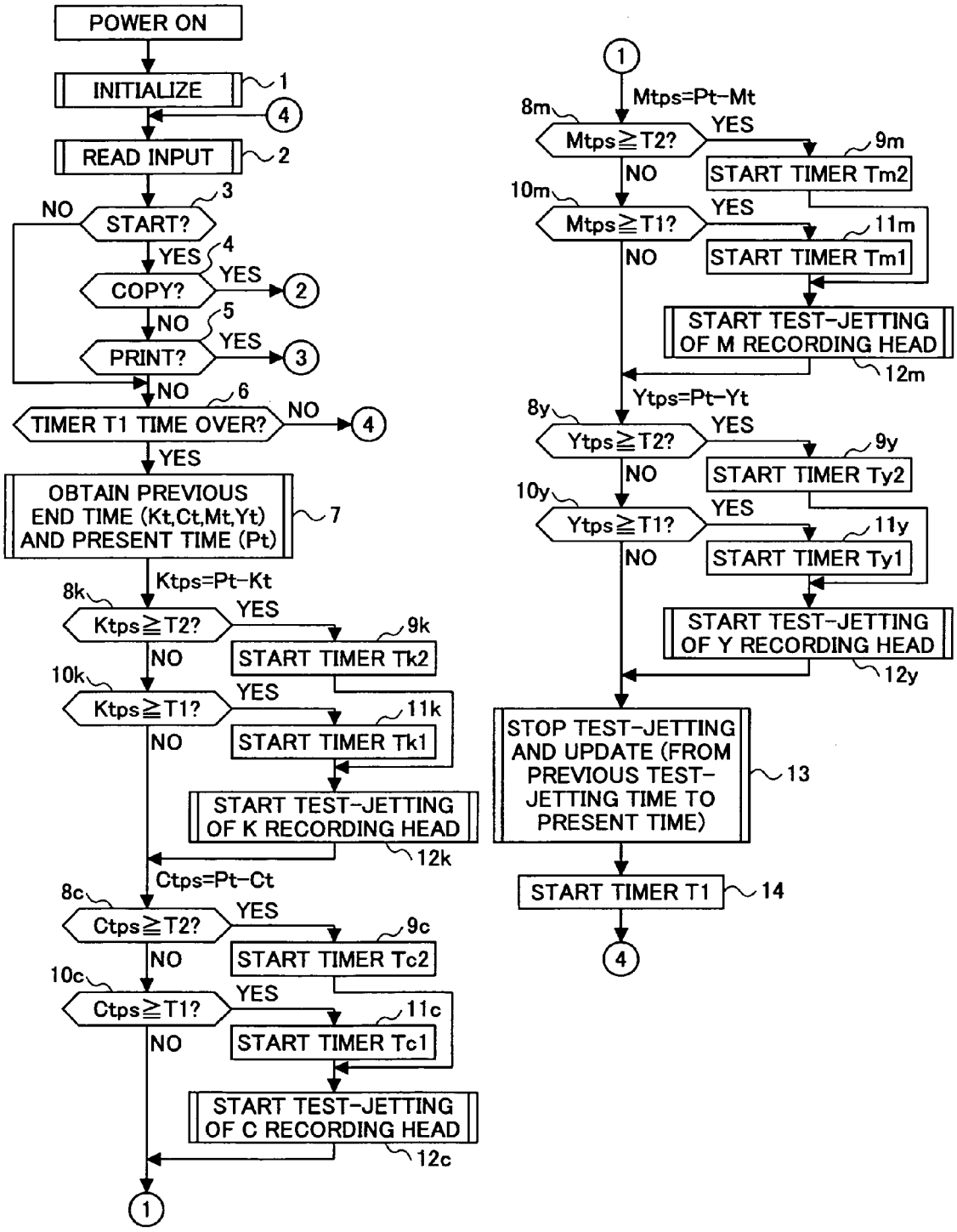
FIG. 4 is a flowchart showing a part of an image forming control process executed by a CPU in an inkjet printer according to an embodiment of the present invention.

FIG. 3 is a schematic drawing showing the functions of the scanner image processing part 303 and the printer image processing part 304 shown in FIG. 2. The RGB image data output from the AFE 111 of the scanner 100 is subjected to a scanner γ correction process by a γ correcting part 306 and then an image area dividing process by an image area dividing part 310. In accordance with the results from the image area dividing part 310, the image data is subjected to a filter process by a filter process part 307, in which the edge areas of the image data are subjected to an edge enhancement process and the middle tone areas (areas at which density smoothly changes) of the image data are subjected to a smoothing process.

For example, in a case where a black and white reading operation or a black and white copying operation is designated by pressing of a "black (BK)" button on a liquid crystal touch panel of the operation board 10, only the G image data being subjected to the edge enhancement process or the smoothing process by the filter process part 307 are written (recorded) in a page memory part 308. In a case where a "full color" button is pressed, RGB image data being subjected to the edge enhancement process or the smoothing process by the filter process part 307 are stored in the memory 406 (See FIG. 2). In a case where no particular color for reading or printing is designated (e.g. where "automatic color selection" is designated or where neither one of the buttons "BK", "full color", "automatic color selection", "cyan (C)", "magenta (M)", and "yellow (Y)" are pressed, the RGB image data processed by the filter process part 307 is stored in the memory 406 and the G image data is written in the page memory 308.

A data selector part 309 selects either the G image data of the page memory part 308 or the RGB data subjected to the edge enhancement process/the smoothing process by the filter process part 307 and outputs the selected data as image data to be readout. Then, the image data output from the page memory part 308 to the image process I/F 305 are handled as Bk image data for a black and white readout process.

The image dividing part 310 includes an edge enhancement part 311 for performing an edge enhancement process on the G image data being subjected to scanner γ correction by the scanner γ correcting part 306. The edge enhancement process part 311 successively performs an edge enhancement process on each pixel assigned to each image data in a data sequence of G image data as target pixels. For example, in a case where each image datum is a 3×3 pixel matrix having the target pixel as the center of the matrix, the image datum being converted into a sum of the product of the edge enhancement coefficients assigned to each pixel of the matrix is set as the edge detection value of the target pixel. The edge detection value represents the definition of the edge.

The edge detection value is subjected to a binarization process by a binarization part 314, in which the edge detection value is converted into binary data (indicative of whether it is an edge candidate (H: edge candidate, L: non edge)) and is then subjected to pattern matching by a pattern matching part 315. Accordingly, it is determined whether the target pixel is situated at an edge position, that is, whether the target pixel is an edge pixel. In other words, it is determined whether the area (region) of the target pixel is a binary image (e.g. text, line) or a middle tone image (e.g. photograph). The pattern matching part 315 determines that the pixel image is an edge area (text area) when the distribution of the area having the target pixel as its center (in this example, 3×3 pixel matrix) matches a predetermined edge pattern.

The determination results (edge (text)/non-edge (photograph)) of the pattern matching part 315 are sent to the filter process part 307. Accordingly, the filter process part 307 performs an edge enhancement process on the area of the γ corrected image data that is determined as an edge, and performs a smoothing process (process for smoothly changing density) on the area of the γ corrected image data that is determined as an non-edge.

An ACS (Auto Color Select) part 317 detects whether the target image data represent a monochrome image or a color image. Accordingly, detection results (monochrome/color detection signals) from the ACS part 317 and determination results (edge/non-edge detection signals) from the image dividing part 310 are sent to a page determination part 318. The page determination part 318 integrates the value of the color of the monochrome/color detection signals with the number of detected pixels (number of image data) and integrates the value of the edge of the edge/non-edge detection signals with the number of detected pixels during an operation of reading the target document. When the reading of a single page of the target document is completed, the page determination part 318 determines whether each of the integrated values is greater than a predetermined value. The image of the target document is determined as color when the number of pixels detected as color is greater than the predetermined value, is determined as monochrome when the number of pixels detected as monochrome is less than the predetermined value. The image of the target document is determined as a binary image (e.g. text image or a liner image, hereinafter simply referred to as text) when the number of pixels detected as edge is greater than the predetermined value, and is determined as a non-edge image (e.g. photograph image, hereinafter simply referred to as photograph). When the reading of a single page of the target document is completed, the CPU 301 refers to the determination results (monochrome/color, text/photograph) of the page determination part 318.

A color correction part 331 of the printer image processing part 304 converts the RGB image data to ymck (recording color) image data and outputs the ymck data to a main scan magnification changing part 332. The main scan magnification changing part 332 changes the magnification in the main scanning direction according to necessity. Then, the ymc data is subjected to printer γ correction by the printer γ correction part 333 so as to be corrected into data that is applicable to the image forming characteristics of the printer 200. Then, after the gradation part 334 converts the ymck data into image data showing density and gradation by a matrix distribution of recorded/unrecorded pixels, the converted ymck data are output to the printer 200. In a case where only G (Bk) image data (i.e. a case of a monochrome image) is obtained, the image data is output to the main scan magnification changing part 332 rather than the color correction part 331. That is, the image data is not subjected to an image correction process.

FIGS. 4 to 7 are flowcharts showing a process of image formation control of the CPU 301 of the engine 300. First, reference is made to FIG. 4. When the printer 200 is switched on and power is provided to the CPU 301, the CPU 301 initializes its input/output ports and its inside register (memory space of the RAM) (Step 1). An input read operation is activated (Step 2). However, since there is no input immediately after power is switched on, the CPU 301, first, obtains the present time from the control board 10 (clock IC of control board 10) and a previous end time list from the HDD 401 via the image data storage part 403 of the controller board 400. The previous end time list, which is subject to non-volatile storage, indicates the previous time when an inkjet head of a predetermined color has executed a jetting operation (sync jetting operation) including a test-jetting operation for nozzle cleaning and an ink jetting operation for printing. In this example, the previous end time list includes an end time Kt corresponding to a K recording head, an end time Ct corresponding to a C recording head, an end time Mt corresponding to a M recording head, and an end time Yt corresponding to a Y recording head.

It is to be noted that Step 6 (a step of determining whether the time for a predetermined timer (T1) is over) is executed after the timer T1 is started in Step 14 (described below). Thus, the timer T1 is not started at a time immediately after the initialization of Step 1. Therefore, at a time immediately after power is switched on, the process proceeds to Step 7 without the determination in Step 6.

The CPU 301 calculates the inkjet discontinue time Ktps of the K recording head (i.e. how long the K recording head has not performed an ink-jetting operation or a test jetting operation) and determines whether the inkjet discontinue time Ktps is equal to or greater than a long time value T2 (second predetermined value) so as to determine the necessity of performing a test-jetting operation (Step 8*k*). In a case where the inkjet discontinue time Ktps is equal to or greater than the long time value T2, a second timer Tk2 is set with a long time value and starts counting time in accordance with the set long time value (Step 9*k*). Then, the cap 244 of the recording head 245 is removed, and the recording head 245 is moved towards the position of the absorbing part 243. Then, the test-jetting operation is started for cleaning the nozzle of the K recording head (Step 12*k*) (Second test-jetting operation). In a case where the inkjet discontinue time Ktps is less than the long time value T2 but equal to or greater than a short time value T1 (first predetermined value), a first timer Tk1 is set with a short time value and starts counting time in accordance with the set short time value (Step 11*k*). Then, the cap 244 of the recording head 245 is removed, and the recording head 245 is moved towards the position of the absorbing part 243. Then, the test-jetting operation is started for cleaning the nozzle of the K recording head (Step 12*k*) (First test-jetting operation).

The steps of determining the necessity of a test-jetting operation and executing the test-jetting operation when determined as necessary also applies to the recording heads of C, M, and Y (Steps 8*c*-12*c*, 8*m*-12*m*, 8*y*-12*y*). When the first and second timers Tk1, Tk2 counts to a predetermined time value (i.e. when the time of the timers Tk1 and Tk2 is over), the CPU 301 stops the test-jetting operation and updates the end time of the corresponding recording head being listed in the previous end time list of the inside RAM of the CPU 301 and the HDD 401. More specifically, the previous end time of the corresponding recording head is re-written with the present time obtained from the control board 10. Then, the front face (exposed face of nozzle) of the recording head 245 is wiped by the wiper 242. Then, the recording head 245 is moved to the position of the cap. Then, the cap 244 is mounted on the recording head 245 (Step 13). Then, a timer T1 is set with a time limit T1 and starts counting time in accordance with the set time limit (Step 14). Then, in a case where the time limit T1 elapses when no copying operation or printing operation is being performed (YES in Step 6), the process moves to Step 7 for determining the necessity of test-jetting.

Regardless of whether any one of the recording heads 245 is in the middle of the first or second test-jetting operation, the CPU 301 proceeds to a copying operation upon receiving a command for starting a copying operation (Steps 41 and after in FIG. 5) from the control board 10 or a personal computer of the user, and proceeds to a printing operation upon receiving a command for starting a printing operation (Steps 41*p* and after in FIG. 7) from the control board 10 or a personal computer of the user.

Figure 5:
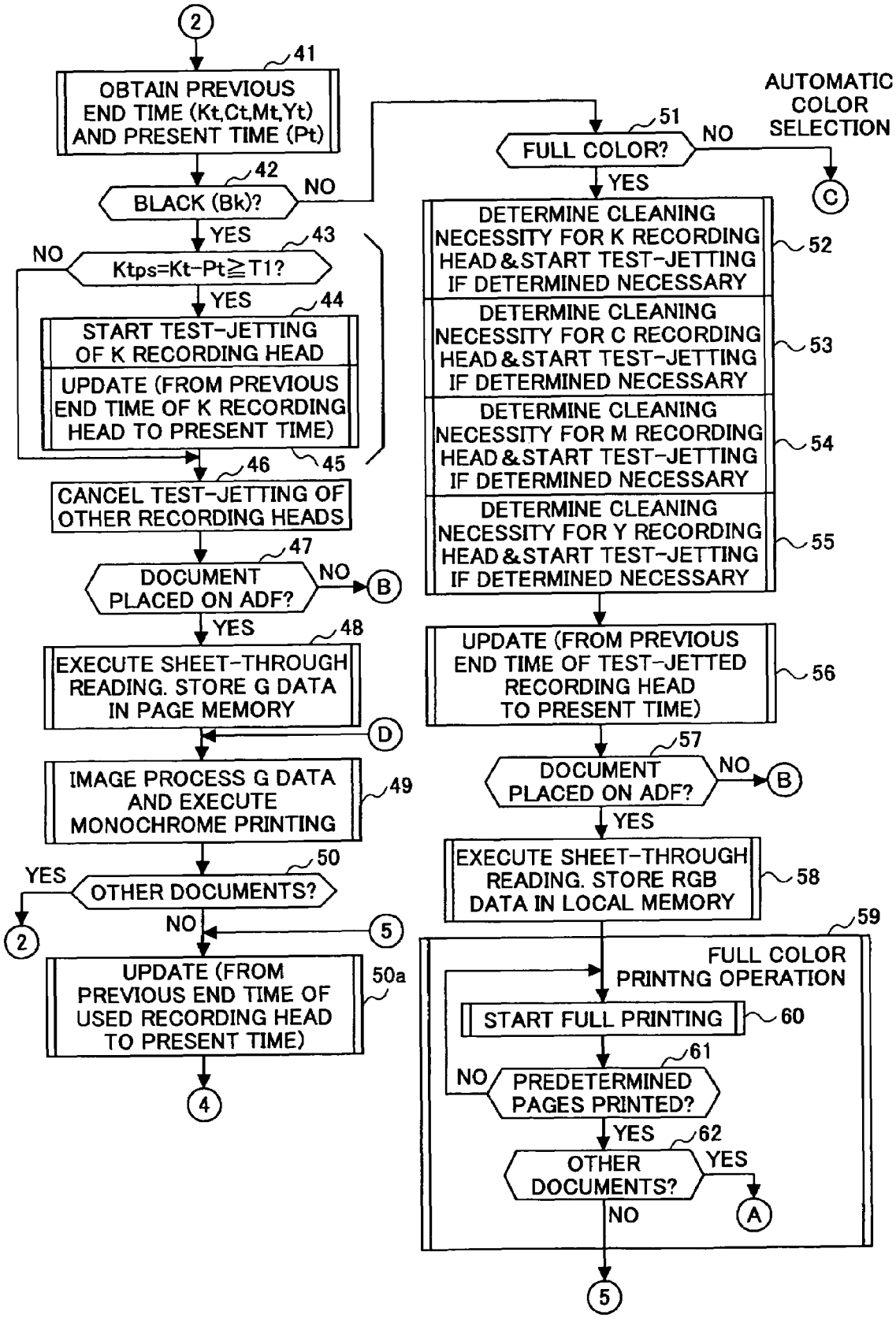
FIG. 5 is a flowchart showing another part of the image forming control process executed by a CPU in an inkjet printer according to an embodiment of the present invention.

Next, reference is made to FIG. 5. Upon receiving the command for starting a copying operation, the CPU 301 obtains the present time from the control board 10 (clock IC of the control board 10) and a previous end time list from the HDD 401 via the image data storage part 403 of the controller board 400 (Step 41). Then, in a case where a black (Bk) button on the liquid crystal touch panel of the control board 10 is pressed for designating a monochrome copying operation (YES in Step 42), the discontinue time Ktps of the K recording head is calculated and is determined whether the discontinue time Ktps is equal to or greater than the first predetermined value T1 (Step 43) for determining the necessity of nozzle cleaning (test-jetting). In a case where the discontinue time Ktps is equal to or greater than the first predetermined value T1, the CPU 401 determines that nozzle cleaning of the recording head is necessary. Then, the cap 244 of the recording head 245 is removed, and the recording head 245 is moved towards the position of the absorbing part 243, to thereby perform the first test-jetting operation for a time period of T1 (Step 44). When the test-jetting operation is finished, the CPU 301 stops the test-jetting operation and updates the end time of the corresponding recording head being listed in the previous end time list of the inside RAM of the CPU 301 and the HDD 401. More specifically, the previous end time of the corresponding recording head is re-written with the present time obtained from the control board 10. In a case where the discontinue time Ktps is less than the first predetermined value T1 (NO in Step S43), the test-jetting operation for the K recording head is not performed. In this stage, when the recording heads for the other remaining colors are in the middle of performing the test-jetting operations in Step 8*c*-12*y* of FIG. 4, the CPU 301 cancels the performing of the test-jetting operations (Step 46).

Next, the CPU 301 determines whether there is a target document(s) placed on the ADF 120 (Step 47). The CPU 301 executes a sheet-through reading operation by using the reading unit 110, performs a filter process (by the filter process part 307) on the read G image data in accordance with the image dividing results, and stores the processed G image data in the page memory part 308 (Step 48). When the sheet-through reading operation for a single document is completed, the CPU 301 reads out the G image data stored in the page memory part 308, performs a predetermined image process (including a binarization process) on the readout G image data at the printer image processing part 304, outputs the processed image data to the recording unit 212 in the printer 200. Thereby, the printer 200 performs a monochrome printing operation (black and white printing operation) based on the image data and prints out a predetermined number of copies (Step 49). This operation is repeated where there is another document placed on the ADF 120 (Steps 50, 41-49). After the printing operation is completed, the CPU 301 updates the end time of the corresponding recording head being listed in the previous end time list of the inside RAM of the CPU 301 and the HDD 401. More specifically, the previous end time of the corresponding recording head is re-written with the present time obtained from the control board 10 (Step 50*a*).

The same as the above-described monochrome copying operation for black, the CPU 301 also performs the above-described nozzle cleaning determination operation and first test-jetting operation in a case where the CPU 301 receives a command for a monochrome copying operation for another color.

Then, in a case where a full color button is pressed for designating a full color copying operation (NO in Step 42), the steps for the nozzle cleaning determination operation and the first test-jetting operation are performed (Steps 51-56) in the same manner as the above-described Steps 43-45. Then, the CPU 301 determines whether there is a target document(s) placed on the ADF 120 (Step 57). The CPU 301 executes a sheet-through reading operation by using the reading unit 110, performs a filter process (by the filter process part 307) on the read RGB image data in accordance with the image dividing results, and stores the processed RGB image data in the local memory part 406 (Step 58). When the sheet-through reading operation for a single document is completed, the CPU 301 reads out the RGB image data stored in the local memory part 406, converts the RGB image data into ymck recording color data at the printer image processing part 304, and outputs respective ymck color image data in parallel to the recording units 212 in the printer 200. Thereby, the printer 200 performs a full color printing operation based on the received image data and prints out a predetermined number of copies (Step 59). This full color copying operation is repeated where there is another document placed on the ADF 120 (Steps 60-61).

After the printing operation is completed, the CPU 301 updates the end time of the corresponding recording head being listed in the previous end time list of the inside RAM of the CPU 301 and the HDD 401. More specifically, the previous end time of the corresponding recording head is re-written with the present time obtained from the control board 10 (Step 50*a*).

Figure 6:
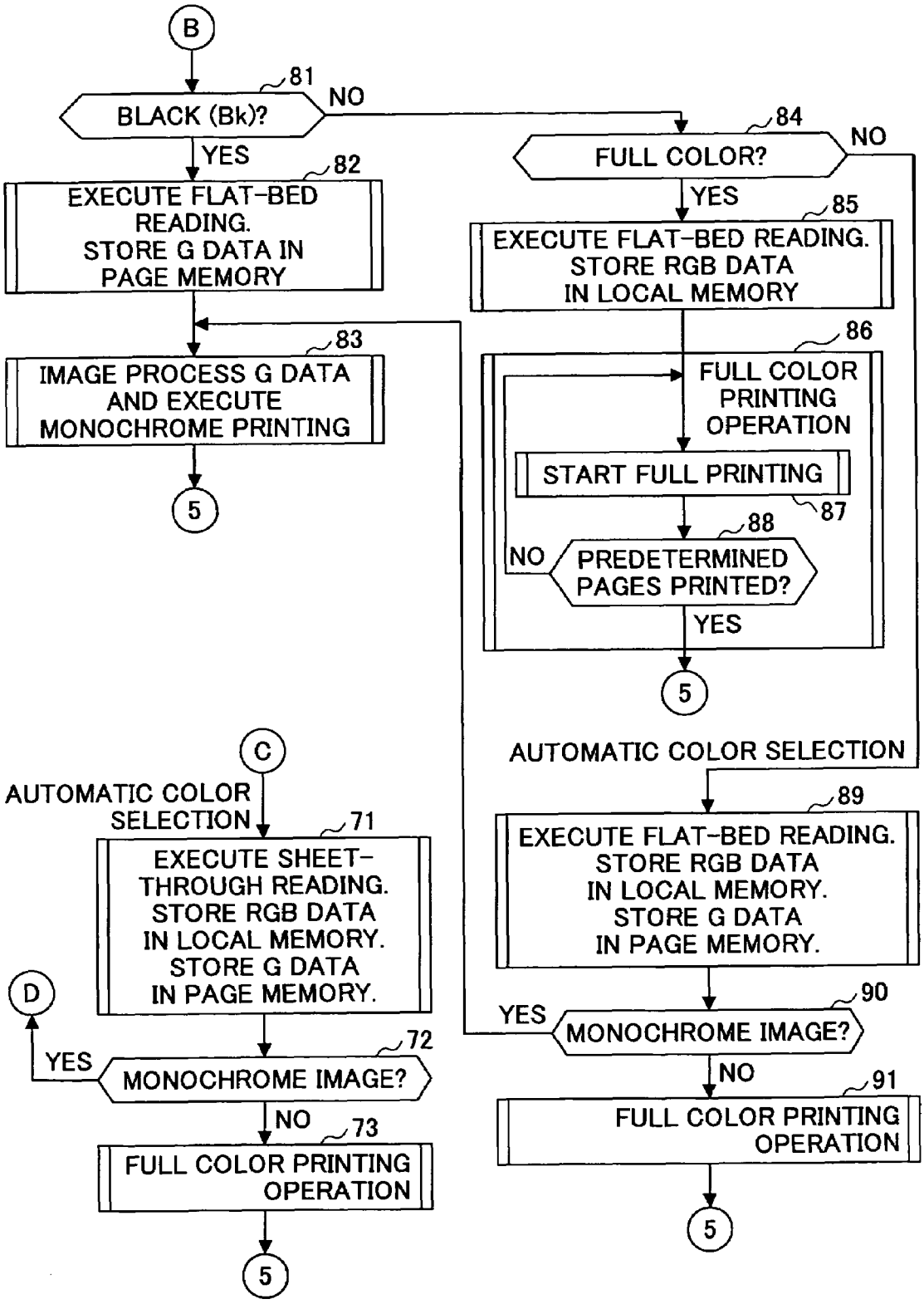
FIG. 6 is a flowchart showing yet another part of the image forming control process executed by a CPU in an inkjet printer according to an embodiment of the present invention.

In a case where the buttons for "black (Bk)", "full color", "automatic color selection", "cyan (C)", "magenta (M)", and "yellow (Y)" are all switched off, or in a case where the button "automatic color selection" is switched on, the printing/copying operation is performed according to an automatic color selection process (See C in FIGS. 5 and 6). In this process, the CPU 301, first, instructs the reading unit 110 to execute a sheet-through reading operation on a target document placed on the ADF 120. Then, the CPU 301 performs a filter process on G image data in accordance with the image dividing results and stores the processed G image data in the page memory part 308, and performs a filter process on RGB image data in accordance with the image dividing results and stores the processed RGB image data in the local memory part 406 (Step 71). Then, the CPU 301 refers to the determination results of the page determination part 318 (Step 72). If it is determined that the target document is a black and white image (monochrome & edge), an operation that is the same as the above-described monochrome copying/printing operation (Steps 49-50) is performed. If the page determination part 318 determines that the target document is not a black and white image, a full color printing operation is performed (Step 73). The full color printing operation of Step 73 is the same as the above-described full printing operation of Step 59.

Next, reference is made to FIG. 6. In a case where the target document is not placed on the ADF 120, the CPU 301 instructs the reading unit 110 to perform a flat bed reading operation on the target document. In this case, when the black (Bk) button is pressed, a monochrome (black and white) copying operation is performed, in which G data is stored in the page memory part 308, the stored G data is subjected to a predetermined image process, and the processed image data is output to the recording unit 212 of the printer 200. Thereby, the printer 200 performs a monochrome printing operation based on the received image data and prints out a predetermined number of copies (Step 81-83). Meanwhile, when the full color button is pressed, a full color printing operation is performed, in which RGB data is stored in the local memory part 406, the stored RGB image data is converted into ymck recording color data at the printer image processing part 304, and the respective ymck color image data is output in parallel to the recording units 212 in the printer 200. Thereby, the printer 200 performs a full color printing operation based on the received image data and prints out a predetermined number of copies (Steps 84-88).

In a case where the buttons for "black (Bk)", "full color", "automatic color selection", "cyan (C)", "magenta (M)", and "yellow (Y)" are all switched off, or in a case where the button "automatic color selection" is switched on, the printing/copying operation is performed according to an automatic color selection process (No in Step 84 of FIG. 6). In this process, the CPU 301, first, instructs the reading unit 110 to execute a flatbed reading operation on a target document. Then, the CPU 301 performs a filter process on G image data in accordance with the image dividing results (based on edge detection amount by the edge enhancement part 311) and stores the processed G image data in the page memory part 308, and performs a filter process on RGB image data in accordance with the image dividing results and stores the processed RGB image data in the local memory part 406 (Step 89). Then, the CPU 301 refers to the determination results of the page determination part 318 (Step 90). If it is determined that the target document is a black and white image (monochrome image), an operation that is the same as the above-described monochrome copying/printing operation (Step 83) is performed. If the page determination part 318 determines that the target document is not a black and white image, a full color printing operation is performed (Step 91). The full color printing operation of Step 91 is the same as the above-described full printing operation of Step 86.

Figure 7:
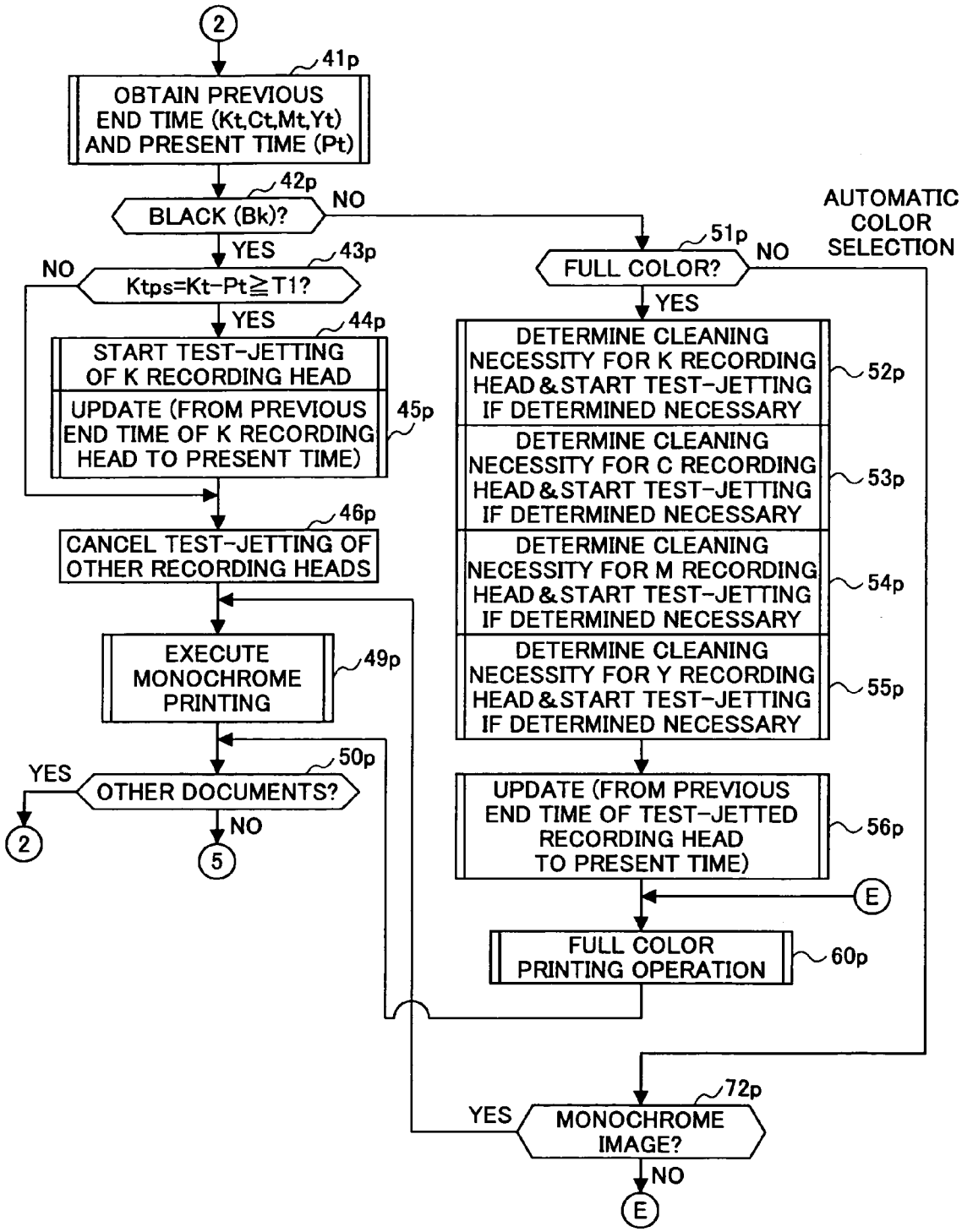
FIG. 7 is a flowchart showing a remaining part of the image forming control process executed by a CPU in an inkjet printer according to an embodiment of the present invention.

FIG. 7 is a flowchart showing an exemplary case where the CPU 301 receives a command for a printing operation instead of the above-described copying operation. Basically, the steps of reading a target document in the copying operation (see FIGS. 5 and 6) are omitted from this printing operation. Accordingly, as shown in FIG. 7, the steps that are substantially the same as those in the copying operation shown in FIGS. 5 and 6 are denoted with the same reference numerals added with a small case letter "p" and further explanation thereof is omitted.

Further, the present invention is not limited to these embodiments, but variations and modifications may be made without departing from the scope of the present invention.

The present application is based on Japanese Priority Application No. 2005-073933 filed on Mar. 15, 2005, with the Japanese Patent Office, the entire contents of which are hereby incorporated by reference.

What is claimed is:

1. An inkjet printer, comprising:

a plurality of inkjet heads for recording one or more colors on a document;

a determining part configured to determine whether a first test-jetting operation is required to be executed by one of the plural inkjet heads designated to record one of the colors on the document; and a recording control part configured to instruct the designated inkjet head to execute the first test-jetting operation prior to recording the one color when the determining part determines that the first test-jetting operation is required to be executed by the designated inkjet head, wherein the determining part is further configured to determine whether the execution of the first test-jetting operation is required during a period of waiting for a command to record the one color on the document, and the recording control part is further configured to instruct the inkjet head determined to require the execution of the first test-jetting operation to execute the first test-jetting operation and the determining part is further configured to cancel the first test-jetting operation for the one color when recording of another color is designated during the first test-jetting operation for the predetermined color.

2. An inkjet printer, comprising:

a plurality of inkjet heads for recording one or more colors on a document;

determining means for determining whether a first test-jetting operation is required to be executed by one of the plural inkjet heads designated to record one of the colors on the document; and recording control means for instructing the designated inkjet head to execute the first test-jetting operation prior to recording the one color when the determining means determines that the first test-jetting operation is required to be executed by the designated inkjet head, wherein the determining means determines whether the execution of the first test-jetting operation is required during a period of waiting for a command to record the one color on the document, and the recording control means instructs the inkjet head determined to require the execution of the first test-jetting operation to execute the first test-jetting operation and the determining means cancels the first test-jetting operation for the one color when recording of another color is designated during the first test-jetting operation for the predetermined color.

* * * * *